United States Patent [19]

Wildenradt

[11] 4,321,810

[45] Mar. 30, 1982

[54] LOCK MECHANISM OF THE SINGLE CYLINDER DEADBOLT TYPE

[76] Inventor: Carl H. Wildenradt, 2358 35th Ave., San Francisco, Calif. 94116

[21] Appl. No.: 118,492

[22] Filed: Feb. 4, 1980

[51] Int. Cl.[3] ..... E05B 65/06

[52] U.S. Cl. ..... 70/129; 70/472; 292/DIG. 27

[58] Field of Search ..... 70/129, 149, 472, 124, 70/125, 128, 135, 144, 145; 292/DIG. 27

[56] References Cited

U.S. PATENT DOCUMENTS

| | | | |
|---|---|---|---|
| 470,474 | 3/1892 | Colley | 70/129 |
| 2,178,666 | 11/1939 | Larson | 70/129 |
| 4,047,408 | 9/1977 | Johns et al. | 70/129 |

*Primary Examiner*—William E. Lyddane
*Attorney, Agent, or Firm*—Victor R. Beckman

[57] ABSTRACT

A deadbolt lock mechanism of the single cylinder type is disclosed having a latch bolt which is movable between extended and retracted positions by a cylinder lock at one side thereof or by rotation of a thumbturn at the other side. With the latch bolt in the retracted position, the thumbturn is axially movable between operative and inoperative positions. In the operative axial position of the thumbturn, the thumbturn is operatively coupled to the latch bolt for operation thereof. In the inoperative axial position of the thumbturn, the thumbturn not only is operatively uncoupled from the latch bolt but also is prevented from rotation.

11 Claims, 6 Drawing Figures

10
12
14
16
18
20
22
24
24A
24B
28
30
32
34
34A
34B
34C
36
36A
36B
36C
38
40
42
42A
44
48
50
52
54
56
60
62
64
66
68
70
72
74
76
76A
2
3

10
14
16
28
32
34
34A
34B
34C
36
36A
36B
36C
38
40
42
42A
44
50
52
54
56

4
24
50
68
70
72
74
76
76A
24B 24
24A
24B
50
70
72
74
76
76A 6
24
24A
24B
50
68
70
72
74
76
76A 24
24B
50
70
72
74
76
76A

LOCK MECHANISM OF THE SINGLE CYLINDER DEADBOLT TYPE

BACKGROUND OF THE INVENTION

Single cylinder deadbolt lock mechanisms having a thumbturn at the side opposite the cylinder lock are well known. Conventional locks of this type provide for extending and retracting the latch bolt by use of either the lock cylinder or the thumbturn. A recognized disadvantage of such lock mechanisms is that a burglar or other such unauthorized person who gains entry to a building may easily exit the same through the door after simply unlocking the same from the inside by use of the thumbturn. For doors with windows, entry to the building is readily gained after first breaking the window and unlocking the door from the inside thereof. Although double cylinder deadbolt locks often are used to prevent such easy exit from a building, they are more expensive than single cylinder locks and, in case of fire or other emergency, may prevent quick egress from the building.

Additionally, single cylinder deadbolt lock mechanisms are known wherein the thumbturn is rendered inoperative when the latch bolt is moved into locking position by key operation of the lock cylinder. Such a lock mechanism is shown in U.S. Pat. No. 2,178,666 issued to O.C. Larson. As with the above-mentioned prior art single cylinder locks of this general type, a major disadvantage of such an arrangement is that the door can not be opened from the inside using the thumbturn after being locked by use of the key from the outside. Any authorized person in the building could not exit through the door once the door is locked by operation of the lock cylinder. An arrangement which avoids this disadvantage is shown in U.S. Pat. No. 4,047,408 issued to Eddie D. Johns, et al wherein the thumbturn is selectively rendered inoperable when the cylinder lock is operated by the key. With this arrangement, if the key is depressed while locking the door, the thumbturn is rendered inoperative and, if not depressed, the thumbturn remains operative. Major disadvantages of such an arrangement include the complexity and cost of manufacturing the same which greatly limit the marketability thereof. Also, the thumbturn disabling mechanism is operated from the cylinder side of the lock rather than from the thumbturn side, thereby contributing to the complexity thereof.

SUMMARY OF THE INVENTION AND OBJECTS

An object of this invention is the provision of an improved single cylinder deadbolt lock mechanism with a thumbturn which avoids the above-mentioned and other shortcomings and disadvantages of prior art single and double cylinder lock mechanisms.

An object of this invention is the provision of an improved single cylinder deadbolt lock mechanism with thumbturn which is of extremely simple design, which may incorporate many standard lock components, and which costs very little more to manufacture than conventional single cylinder deadbolt lock mechanisms with thumbturn which is always enabled.

An object of this invention is the provision of means whereby conventional single cylinder deadbolt lock mechanisms may be readily converted to locks with a thumbturn which are rendered operative or inoperative for actuation of the latchbolt simply by axial movement of the thumbturn between operative and inoperative positions when the latch bolt is in the retracted position.

The above and other objects and advantages of this invention are achieved by use of a latch bolt movable between extended and retracted positions by use of spindle bar means connected thereto through a rotatable crank. A lock cylinder with a rotatable plug, located at one side of the lock mechanism, is coupled through a lost-motion connection to the spindle bar means for key operation of the latch bolt between retracted and extended positions. A thumbturn at the opposite side of the lock mechanism is releasably coupled to the spindle bar means by axial movement thereof between operatively coupled and uncoupled positions when the latch bolt is in retracted position. In the uncoupled axial position, rotation of the thumbturn is prevented by cooperating members on the thumbturn and escutcheon plate rotatably supporting the same. The cooperating members are interengaged in the inoperative axial position of the thumbturn to prevent rotation thereof.

BRIEF DESCRIPTION OF THE DRAWINGS

The invention, together with other objects and advantages thereof will be better understood from the following description considered with the accompanying drawings. In the drawings, wherein like reference characters refer to the same parts in the several views.

Figure 1:
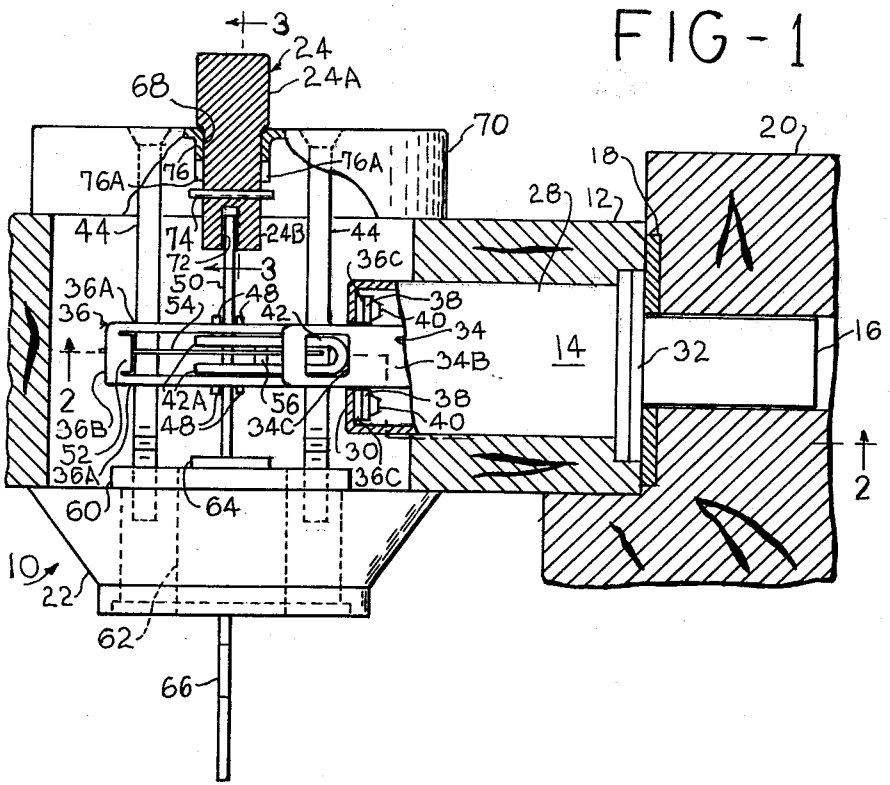
FIG. 1 is a horizontal sectional view through a door and lock mechanism which embodies the present invention and showing the latch bolt of the lock mechanism in extended locking position by operation of a cylinder lock, parts of the latch unit being shown broken away for clarity.

Reference first is made to FIG. 1 of the drawings wherein the novel lock mechanism 10 of this invention is shown installed on a door 12. The lock mechanism 10 includes a latch unit 14, which may be of conventional design, and which includes a latch bolt 16 movable into and out of engagement with an aperture in a strike plate 18 at the door jamb 20 by operation of a cylinder lock 22 at the outer face of the door or a thumbturn 24 at the inner face thereof. The thumbturn 24 is releasably coupled to the latch bolt 16 through novel coupling means described in detail hereinbelow. However, before describing the novel coupling means, the substantially conventional latch unit 14 and cylinder lock 22 will be described.

The latch unit 14 includes a cylindrical shaped housing 28 formed at the inner end with an end wall 30 having an elongated, generally rectangular shaped aperture formed therein. A faceplate 32 at the outer end of the housing 28 is formed with an aperture in the shape of the latch bolt cross-section into which the latch bolt extends for slidable support thereat. Screws, now shown, secure the face plate 32 to the edge of the door 12 at a mortice formed therein.

Figure 2:
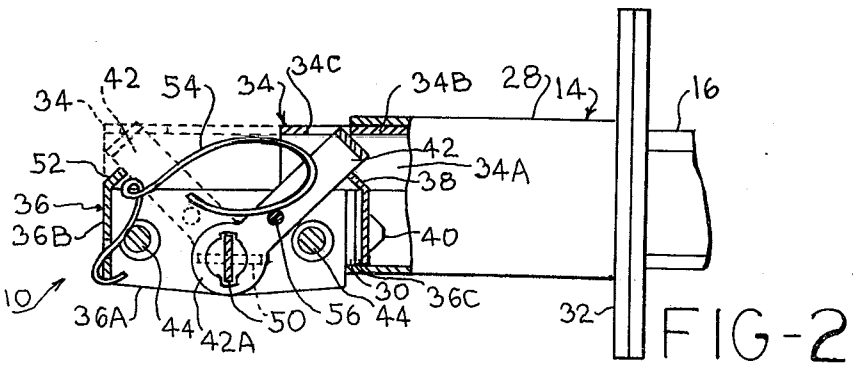
FIG. 2 is a fragmentary sectional view of the lock mechanism taken substantially along line 2—2 of FIG. 1.

A latch bar 34 is fixedly secured, by means not shown, to the latch bolt 16, and extends rearwardly thereof through the aperture in the housing end wall 30. The rearwardly extending portion of the illustrated latch bar 34 is in the form of a channel member having a generally inverted U-shaped cross-section and including spaced vertical wall members 34A, 34A (only one of which is seen in FIG. 2) and an interconnecting upper wall 34B. A camming aperture 34C is formed in the connecting wall 34B adjacent the rear of the latch bar for use in actuating the latch bar and attached latch bolt 16 between extended and retracted positions in a manner described below.

A latch bar supporting member 36 is fixedly attached to the rear, or inner, wall 30 of the housing 28 and extends rearwardly thereof. The supporting member 36 is formed with spaced vertical side walls 36A, 36A which underlie the latch bar walls 34A, 34A for slidable support of the latch bar 34 on said supporting member 36. An end wall 36B joins the side walls 36A, 36A at the inner, or rear, end thereof. The forward end of the supporting member 36 extends through the aperture in the end wall 30 of the housing 28, and sidewardly extending mounting flanges 36C, 36C are formed thereat for use in attachment of the supporting member 36 to the housing 28. A stop member 38 also is located at the forward end of the supporting member 36, and the mounting flanges 36C, 36C are sandwiched between the housing end wall 30 and stop member 38. Means, such as staking 40, 40 at the housing 28 secure the supporting and stop members 36 and 38, respectively, to the housing end wall 30. The stop member 38 includes a central section at the aperture in the end wall 30 which serves to limit pivotal movement, in one rotary direction, of a crank, or actuating lever 42 rotatably mounted on the supporting means 36.

The side walls of the supporting means 36 are formed with clearance holes adjacent opposite ends thereof through which mounting screws 44, 44 extend. Also, central, axially aligned, openings are formed in the side walls 36A, 36A for the rotatable support of the crank 42. The illustrated crank comprises a U-shaped member which includes a pair of parallel arms joined at one end and formed with hubs 42A, 42A at the opposite free arm ends. The hubs 42A, 42A have central positions which are bent outwardly to form pairs of prongs 48,48 which extend through the central apertures in the walls 36A, 36A of the supporting member 36 for rotatable support of the crank 42 about the aperture axes. Spindle bar means 50 extend through the spaces between the prongs 48,48 for non-rotatably coupling the same to the crank 42.

The crank 42 engages the camming aperture 34C formed in the latch bar 34 for actuation of the attached latch bolt 16 between retracted and extended positions upon rotation of the crank 42 by spindle bar means 50. Rotation of the crank 42 in the bolt-extending position is limited by engagement thereof with the stop member 38. A stop member 52 formed at the upper edge of the rear wall 36B of the support member 36 limits rotation of the crank 42 in the opposite, bolt-retracted, direction. Spring means 54 attached to the rear wall 36B engages a pin 56 extending between the parallel arms of the crank 42 to provide a snap-over action for resiliently biasing the crank in either rotary direction, depending upon which side of "dead-center" position the crank is located. Such snap-over means maintains the crank 42 in either rotary end position, and prevents rotation thereof except through positive drive rotation by the spindle bar means 50.

The cylinder lock 22 which, as mentioned above, also may be of conventional design, includes a housing 60 containing a tumbler cylinder 62 in which a cylinder plug 64 is rotatably mounted through use of a key 66. A lost-motion connection, not shown, of conventional design, connects the cylinder plug 64 to spindle bar means 50 for drive rotation thereof. As is well understood, the lost-motion connection allows for return rotation of the key 66 to a position allowing for removal of the key from the cylinder plug without corresponding rotation of the spindle bar means following key locking and unlocking operations. With the key 66 inserted in the cylinder lock 22, the spindle bar means 50 and attached crank 42 may be rotated in a clockwise direction, as viewed in FIG. 2, during which rotation the crank 42 drives the latch bar 34 and attached latch bolt 16 into extended, locking, position shown in FIGS. 1 and 2. Rotation of the crank 42 in a counterclockwise direction by spindle bar 50 returns the latch bar 34 and attached latch bolt 16 to retracted, unlocked, position shown in broken lines in FIG. 2. With the present arrangement, the latch bolt 16 is movable between retracted and extended positions by means of the cylinder lock 22 for both locking and unlocking operations regardless of the operating position of the thumbturn and whether or not the thumbturn is coupled to spindle bar means 50.

Figure 3:
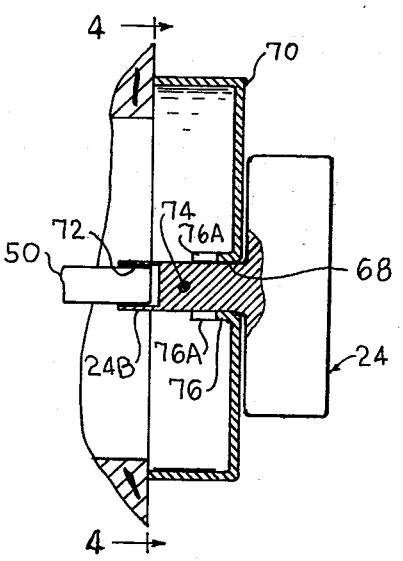
FIG. 3 is a fragmentary sectional view of the coupling means for releasably coupling the thumbturn to the spindle bar means taken substantially along lines 3—3 of FIG. 1.
Figure 4:
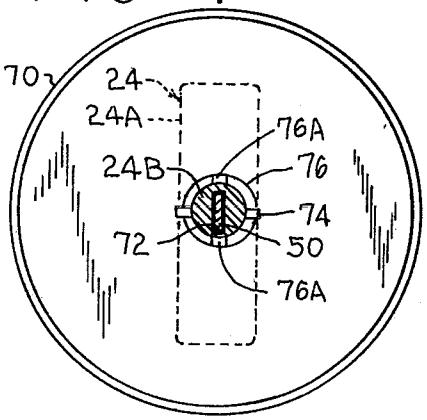
FIG. 4 is a sectional view taken along line 4—4 of FIG. 3.

The coupling means whereby the thumbturn is releasably coupled to spindle bar means 50 now will be described. The thumbturn 24, as seen in FIGS. 1, 3 and 4, includes a knob 24A with an integral cylindrical shaft 24B which extends through an axially-flanged aperture 68 formed in the interior escutcheon plate 70 for rotatable support of the thumbturn on the escutcheon plate, when the thumbturn is operatively engaged with the spindle bar means 50 (FIG. 1–4). With the spindle bar means 50 in the latch bolt retracting position, as shown in broken lines in FIGS. 2 and 5, the thumbturn 24 is also axially movable between operatively coupled and uncoupled conditions with said spindle bar means. The illustrated spindle bar means 50 is of generally rectangular cross-sectional shape, and releasable coupling means for coupling the same to the thumbturn may simply include a slot 72 matingly engagable with the free end of the spindle bar means. In the coupled condition, illustrated in FIGS. 1–4, it will be apparent the spindle bar means is rotatably by the thumbturn for rotation of the crank 42 and axial movement of the latch bolt 16 between bolt-extended and bolt-retracted positions. It will be seen, then, that in the operative position of the thumbturn wherein the thumbturn and spindle bar means are operatively coupled, the lock mechanism functions as a conventional single cylinder deadbolt type lock mechanism with a thumbturn which is key-operated from the cylinder side and manually operable from the thumbturn side thereof.

Figure 5:
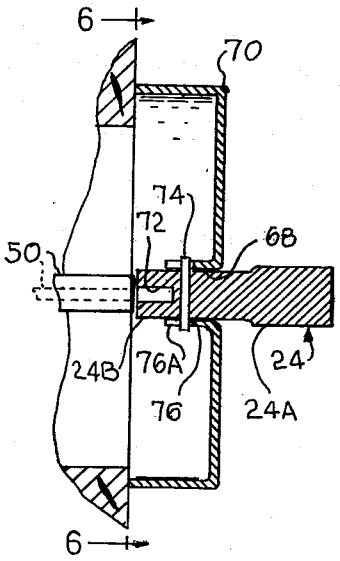
FIG. 5 is a fragmentary cross-sectional view which is similar to that of FIG. 3 but showing the thumbturn in the inoperative position, uncoupled from the spindle bar means.
Figure 6:
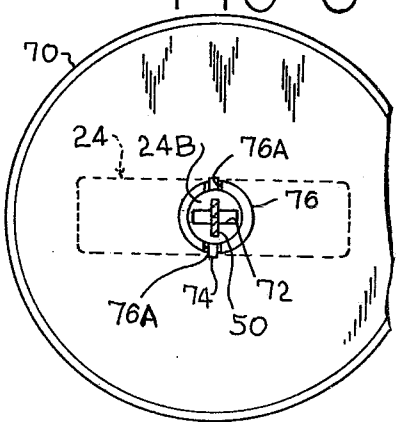
FIG. 6 is a cross-sectional view which is similar to that of FIG. 4 taken along line 6—6 of FIG. 5.

As noted above, in the latch bolt retracted condition of the mechanism, the thumbturn 24 is axially movable between said coupled and uncoupled conditions, and in FIGS. 5 and 6, the thumbturn is shown axially retracted for disengagement thereof from the spindle bar means.

In such uncoupled condition, it will be apparent that the spindle bar means 50 may be rotated for operation of the latch bolt by the cylinder lock but not by means of the thumbturn. Now, with the thumbturn operatively uncoupled from the spindle bar means, the lock mechanism simply functions as a conventional single cylinder deadbolt without a thumbturn, which is only key-operated from the cylinder side thereof.

The novel mechanism is provided with means for preventing rotation of the thumbturn 24 when in the uncoupled condition. To this end, the thumbturn 24 and escutcheon plate 70 are provided with cooperating members 74 and 76 which are operatively engaged in the inoperative axial position of the thumbturn to prevent thumbturn rotation. For purposes of illustration, the one cooperating member 74 is shown comprising a pin carried by the thumbturn shaft 24B and extending outwardly therefrom at diametrically opposite sides thereof, and the other cooperating member 76 is shown comprising an axial flange on the escutcheon plate formed with a pair of diametrically opposite notches 76A, 76A at the inner end thereof into which the pin 74 ends extend in the inoperative axial position of the thumbturn. It will be seen then, that not only is the thumbturn 24 disengaged from the spindle bar means 50, but it also is prevented from rotation when in the inoperative axial position illustrated in FIGS. 5 and 6. Rotation of the thumbturn 24 to place the coupling slot 72 into alignment with the spindle bar means 50 when the spindle bar means is in the latch bolt extended position is thereby prevented. When the thumbturn is in the uncoupled position, and the latch bolt 16 is extended by operation of the cylinder lock, as illustrated in FIGS. 5 and 6, the slot 72 in the thumbturn and spindle bar means 50 are misaligned to prevent mating engagement therebetween. Since rotation of the thumbturn is prevented by engagement of the ends of pin 74 in the escutcheon plate notches 76A, 76A, rotation of the thumbturn slot 72 into alignment with the spindle bar means is prevented, thereby preventing operation of the lock mechanism by the thumbturn until the spindle bar is rotated by the cylinder lock into latch bolt retracted position. Now, the thumbturn is free for axial movement into mating engagement with spindle bar means 50. In FIG. 5, the broken line showing of the spindle bar means 50 shows the same in the latch bolt retracted position, in alignment with the slot 72. It here will be noted that releasable detent means, not shown, may be included to releasably maintain the thumbturn in the opposite axial positions thereof to prevent inadvertent simultaneously coupling of the thumbturn and spindle bar means, and the thumbturn and escutcheon plate which would result in a locking of the parts against rotation.

The invention having been described in detail in accordance with requirements of the Patent Statutes, various other changes and modifications will suggest themselves to those skilled in this art. For example, spindle bar means 50 may comprise separate axially aligned sections, with one section extending between the cylinder lock 22 and crank 42, and another section extending between the crank 42 and thumbturn 24. Additionally, latch units 14 and cylinder locks of different design may be employed in the mechanism, the invention residing primarily in the novel coupling for the thumbturn, and not in the illustrated latch unit and cylinder lock. Obviously, lock mechanisms not of the cylinder lock type also may be employed; cylinder locks being a most common type. It is intended that the above and other such changes and modifications shall fall within the spirit and scope of the invention as defined in the appended claims.

I claim:

1. In a lock mechanism of the type which includes a cylinder lock positionable at one side of a door in a axially fixed relationship with the door, a rotatable thumbturn positionable at the other side of the door opposite said cylinder lock, and a latchbolt operated between extended and retracted positions by operation of said cylinder lock and said thumbturn, the improvement comprising means for mounting said thumbturn for axial movement between operative and inoperative positions wherein said thumbturn is operatively coupled to said latch bolt for operation of the latch bolt in the operative axial position thereof and is operatively uncoupled from said latch bolt and prevented from rotation in the inoperative axial position thereof.

2. In a lock mechanism as defined in claim 1 wherein said mounting means includes an escutcheon plate for the rotatable and axially movable support of said thumbturn, said thumbturn and escutcheon plate having cooperating members engagable in the inoperative axial position of the thumbturn to prevent rotation thereof while allowing for axial movement.

3. In a lock mechanism as defined in claim 2 wherein said cooperating members also are engagable in the operative axial position of the thumbturn to prevent axial movement of the thumbturn into said inoperative axial position when the latchbolt is in the extended position.

4. In a lock mechanism as defined in claim 1 of the type which also includes rotatable spindle bar means for connecting said latch bolt to said cylinder lock and to said thumbturn, and wherein said mounting means for said thumbturn includes a mounting shaft on the thumbturn for the rotatable and axially movable support of the thumbturn, said mounting shaft being formed with a slot at the inner end thereof engagable by said spindle bar means for operatively coupling said latch bolt to said thumbturn in the operative axial position of the thumbturn.

5. In a lock mechanism as defined in claim 4 wherein said mounting means also includes an escutcheon plate formed with an apertured supporting means for the rotatable and axially movable support of said thumbturn mounting shaft.

6. In a lock mechanism as defined in claim 5 wherein said apertured supporting means of the escutcheon plate and mounting shaft of the thumbturn include cooperating members engagable in the inoperative axial position of the thumbturn to prevent rotation of the thumbturn while allowing for axial movement thereof.

7. In a lock mechanism as defined in claim 6 wherein said cooperating members include a notch formed at the inner end of the apertured supporting means of the escutcheon plate and a pin attached to and extending radially from the thumbturn mounting shaft movable into said notch to prevent rotation of the thumbturn.

8. A lock mechanism comprising, a latch bolt movable between extended and retracted positions, spindle bar means connected to said latch bolt for operation thereof between said extended and retracted positions upon rotation of said spindle bar means, key operated means accessible from one side of the lock mechanism for rotating said spindle bar means for operation of said latch bolt, a rotatably mounted thumbturn at the other side of the lock mechanism axially movable between an operative axial position wherein said thumbturn is operatively coupled to said spindle bar means and an inoperative axial position wherein said thumbturn is operatively uncoupled from said spindle bar means, and means for preventing rotation of said thumbturn in said inoperative axial position thereof.

9. A lock mechanism as defined in claim 8 wherein said thumbturn is limited to rotary movement in operative axial position thereof when the latch bolt is moved into extended position by operation of said spindle bar means.

10. A lock mechanism as defined in claim 8 including an escutcheon plate for the rotatable and axially movable support of said thumbturn, and wherein said preventing means comprise cooperating members on said escutcheon plate and thumbturn which are operatively engaged in the inoperative axial position of the thumbturn to prevent rotation of the thumbturn while allowing for axial movement thereof into operative axial position of the thumbturn.

11. A lock mechanism as defined in claim 8 wherein said thumbturn and spindle bar means are formed with mating surfaces movable into and out of mating relationship by axial movement of said thumbturn only in the retracted position of the latch bolt.

* * * * *